US007544115B2

(12) United States Patent
O'Moore

(10) Patent No.: US 7,544,115 B2
(45) Date of Patent: Jun. 9, 2009

(54) CHEMICAL MECHANICAL POLISHING ASSEMBLY WITH ALTERED POLISHING PAD TOPOGRAPHICAL COMPONENTS

(75) Inventor: Fergal O'Moore, Los Gatos, CA (US)

(73) Assignee: Novellus Systems, Inc., San Jose, CA (US)

( * ) Notice: Subject to any disclaimer, the term of this patent is extended or adjusted under 35 U.S.C. 154(b) by 0 days.

(21) Appl. No.: 11/858,789

(22) Filed: Sep. 20, 2007

(65) Prior Publication Data

US 2009/0081932 A1 Mar. 26, 2009

(51) Int. Cl.
*B24B 29/00* (2006.01)

(52) U.S. Cl. ..... 451/64; 451/288; 451/290; 451/550; 451/551

(58) Field of Classification Search ..... 451/285, 451/286, 287, 288, 289, 290, 527, 550, 551, 451/64

See application file for complete search history.

(56) References Cited

U.S. PATENT DOCUMENTS 5,431,596 A * 7/1995 Akita et al. ..... 451/540
5,650,039 A * 7/1997 Talieh ..... 216/89
5,842,910 A * 12/1998 Krywanczyk et al. ..... 451/41
5,944,583 A * 8/1999 Cruz et al. ..... 451/41
6,824,455 B2 * 11/2004 Osterheld et al. ..... 451/285
7,252,582 B2 * 8/2007 Renteln ..... 451/527

* cited by examiner

*Primary Examiner*—Timothy V Eley
(74) *Attorney, Agent, or Firm*—Ingrassia Fisher & Lorenz, P.C.

(57) ABSTRACT

A chemical-mechanical polishing apparatus is provided that creates a uniform kinematical pattern on the surface of a wafer being polished. The apparatus may have a polishing pad comprising a polishing pad surface having a center point that lies within an axis of motion for the polishing pad and a plurality of grooves entrenched in the polishing pad surface and defining a pattern of shapes. The pattern has an axis of symmetry that is offset from the polishing pad surface center point. The apparatus may be operated in a manner such that the kinematics of the CMP process are uniform across the surface of the wafer.

3 Claims, 6 Drawing Sheets

CHEMICAL MECHANICAL POLISHING ASSEMBLY WITH ALTERED POLISHING PAD TOPOGRAPHICAL COMPONENTS

FIELD OF THE INVENTION

The present invention relates to an apparatus for chemical-mechanical polishing. More particularly, the present invention relates to work piece planarization enhancement through dynamic alteration of polishing pad topographical components with respect to a substrate that is being polished.

BACKGROUND

Chemical-mechanical polishing (CMP) is the process of removing material from a work piece to create a smooth planar surface. In a conventional CMP assembly, the work piece is secured in a carrier head such that the surface to be polished is exposed. The exposed surface of the wafer is then held against a polishing pad. One side of the polishing pad has a polishing surface thereon, and an opposite side is mounted to a rigid platen. Pressure is exerted on a back surface of the work piece by a flexible diaphragm in the carrier head in order to press the work piece front surface against the polishing pad. Polishing slurry is introduced to the polishing surface while the work piece and/or polishing pad are moved in relation to each other by means of motors connected to the shaft and/or platen. This relative motion may be linear, rotational, orbital or other such multi-directional motion. One way that the slurry is supplied to the polishing surface is through one or more holes in the polishing pad. The holes in the polishing pad are in communication with a supply source via holes or passageways provided in the platen. Another way that the slurry is supplied to the polishing surface is by metering the slurry onto the polishing pad from a nozzle.

The combination of chemical reactions and mechanical forces of the CMP process results in removal of material from the work piece front surface to form a substantially planar surface. One requisite for removing material from the work piece surface at a high rate ("removal rate") and with a uniform removal rate across the entire surface is the rotation of the polishing pad and/or the work piece in a manner whereby any grooves or other topographical features on the polishing pad traverse the wafer surface in a uniform manner. A non-uniform material removal rate will result if particular grooves or other topographical features on the polishing pad are biased to repeatedly traverse particular wafer surface regions during polishing.

The pattern traced on the wafer surface by a given point on the polishing pad is determined by the kinematics of the particular CMP apparatus being employed and on the particular settings for the process parameters controlling operation of that apparatus. For example, if the CMP apparatus is an orbital CMP apparatus, the wafer undergoes a number of motions relative to the polishing pad: orbital motion, rotational motion, and angular oscillation motion. The kinematics of the CMP operation depend on the parameters governing these motions such as orbiting radius, orbiting speed, wafer rotation speed, angular oscillation range, oscillation speed, and upper-to-lower head offset (the offset of the axis of the carrier head with respect to the center of the polishing pad). The combination of these parameters affects the "kinematical pattern" on the wafer traced by a particular point on the polishing pad, and, indirectly, the probability of a specific location on the wafer being exposed to a groove or other topographical feature on the polishing pad. These parameters and their effect will vary depending on the particular type of CMP apparatus being employed.

As an alternative to traditional CMP, electrochemical mechanical polishing (ECMP) can be used for polishing the work piece. ECMP is a type of CMP process that involves removal of material from the surface of the work piece through the action of an electrolyte solution, electricity, and relative motion between the work piece and the polishing pad. The ECMP process has the same requirement for uniform removal of material from the wafer and the need for a uniform "kinematical pattern" traced by relative motion between the wafer and the polishing pad.

Accordingly, it is desirable to provide a chemical mechanical polishing assembly that achieves a controllable and uniform material removal rate during a CMP process. In addition, it is desirable to provide a CMP apparatus that creates a uniform kinematical pattern on the wafer surface. This may be accomplished by utilizing a polishing pad that includes topographical features that uniformly traverse a wafer surface during a CMP process. It may also be accomplished by optimizing the process parameters that control the kinematics of the CMP process during operation of the apparatus. Furthermore, other desirable features and characteristics of the present invention will become apparent from the subsequent detailed description and the appended claims, taken in conjunction with the accompanying drawings and the foregoing technical field and background.

BRIEF SUMMARY

A chemical-mechanical polishing apparatus in accordance with an exemplary embodiment of the present invention is provided. The chemical-mechanical apparatus has a polishing pad that comprises a polishing pad surface having a center point that lies within an axis of motion for the polishing pad and a plurality of grooves entrenched in the polishing pad surface and defining a pattern of shapes. The pattern of shapes has an axis of symmetry that is offset from the surface center point.

A chemical-mechanical polishing assembly in accordance with an exemplary embodiment of the invention is provided. The chemical-mechanical polishing assembly comprises a platen and a polishing pad disposed over the platen. The polishing pad has a top surface. The top surface has a center point that lies within an axis of motion for the polishing pad. A plurality of grooves is entrenched in the top surface and defines a pattern of shapes, each shape having an axis of symmetry that is offset from the top surface center point.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Although the present invention may be used to remove material or deposit material on the surface of a variety of work pieces such as magnetic disks, optical disks, and the like, the invention is conveniently described below in connection with removing and depositing material on the surface of a wafer. In the context of the present invention, the term "wafer" shall mean semiconductor substrates, which may include layers of insulating, semiconductor, and conducting layers or features formed thereon and used to manufacture microelectronic devices.

The terms "polishing" and "planarization", although having different connotations, are often used interchangeably by those skilled in the art. For ease of description such common usage will be followed and the term "CMP" may convey either "chemical mechanical polishing" or "chemical mechanical planarization." The terms "polish" and "planarize" will also be used interchangeably.

Figure 1:
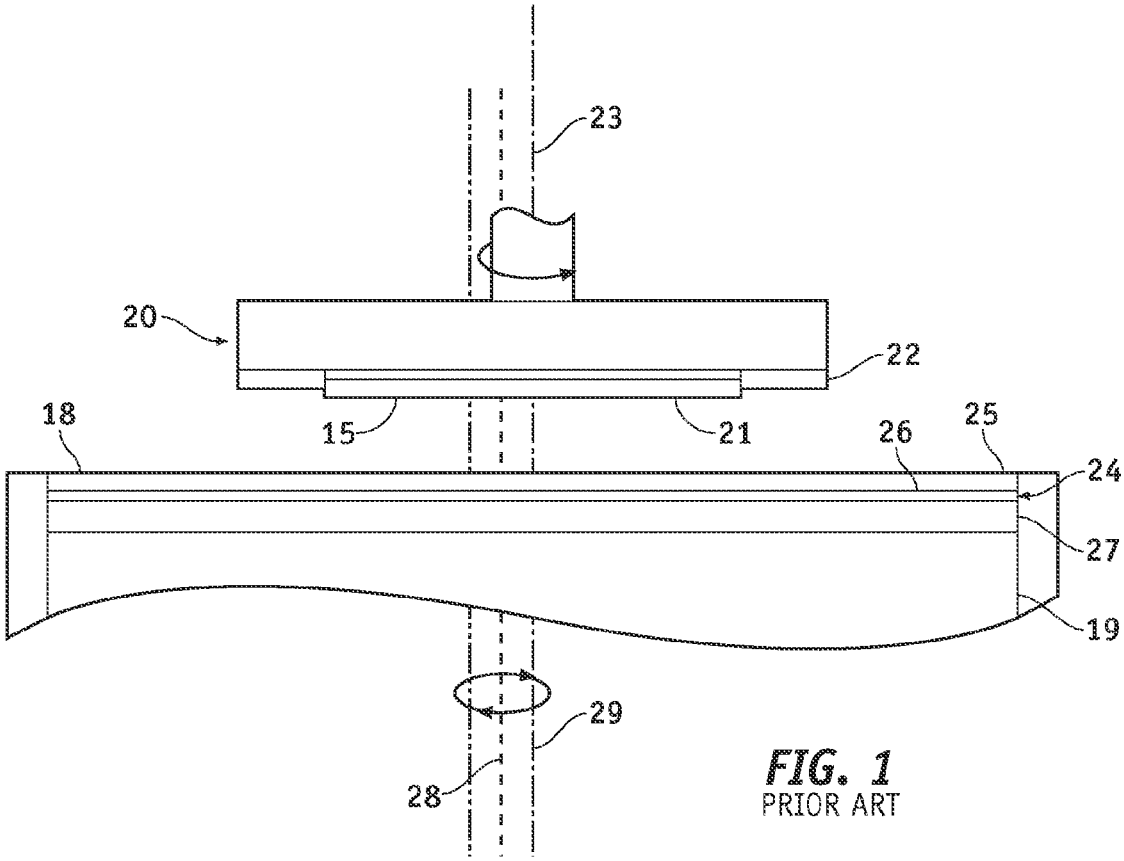
FIG. 1 PRIOR ART
FIG. 1 is a cross-sectional view of an orbital CMP apparatus.

The present invention is capable of being implemented with a variety of CMP systems. One exemplary CMP system is depicted in FIG. 1. The CMP system performs an orbital polishing technique. A carrier head 20 is used to hold a wafer 21. The back surface of the wafer is held flush against a flexible membrane (not shown) within a retaining ring 22, also called a wear ring. During a polishing operation, the carrier head 20 rotates about an axis 23 that extends through the center of the wafer 21. While the carrier head 20 rotates, the wafer 21 is brought into contact with a pad assembly 24. The pad assembly 24 includes a polishing pad 25 with a polishing pad surface 18 parallel with and contacting a wafer surface 15 during the polishing operation. The pad assembly 24 may contain an optional subpad 26 located under the polishing pad. The pad assembly 24 is mounted on a table or platen 19, with a relatively hard and rigid backing plate 27. The platen 19 may optionally contain a multi-layered manifold system (not shown) with slurry supply and/or exhaust holes or passageways provided in the manifold to deliver and/or remove slurry to and/or from the top surface of the polishing pad. During the polishing operation, the pad assembly 24 is moved in a rotational or orbital motion about a platen axis 28 while the carrier head 20 simultaneously rotates the wafer 21 about the carrier head axis 23. In a typical CMP process, the carrier head axis 23 is offset from the platen axis 28 by an amount referred to as the upper-to-lower head offset (i.e., the offset of the center of the wafer with respect to the center of the polishing pad).

Figure 2:
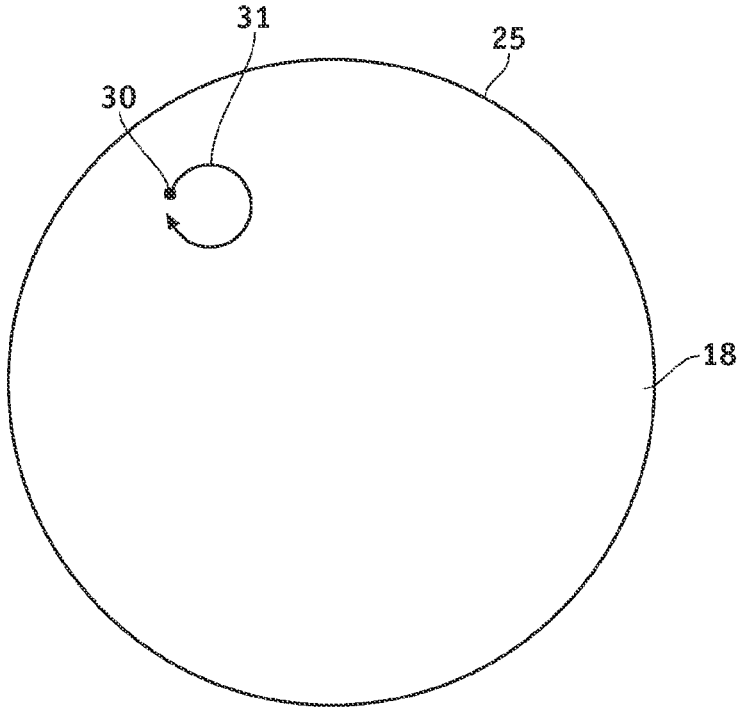
FIG. 2 PRIOR ART
FIG. 2 is a top view of a CMP apparatus polishing pad that is performing an orbital polishing technique.
Figure 3:
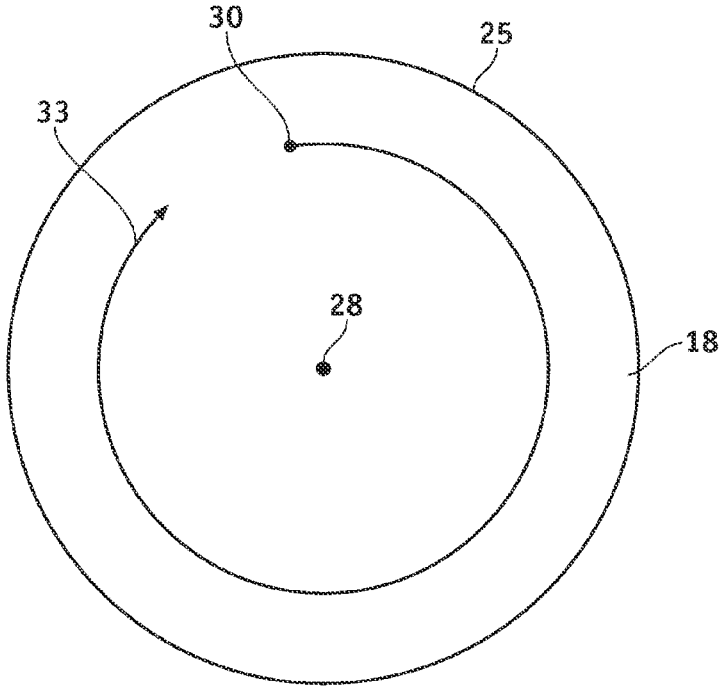
FIG. 3 PRIOR ART
FIG. 3 is a top view of a CMP apparatus polishing pad that is performing a rotational polishing technique.

During the polishing process, slurry is delivered to the polishing pad surface 18. Movement of slurry particles during polishing is substantially dictated by grooves or other topographical features on the polishing pad, by the kinematics of the relative motion between the wafer 21 and polishing pad 25, and by shear forces acting on the slurry from contact with the moving wafer. FIGS. 2 and 3 show a top view of the polishing pad 25. In a preferred embodiment of the invention shown in FIG. 2, the platen moves in an orbital path. The arrow 31 in FIG. 2 represents the motion of a point 30 on the polishing pad surface 18 during a single orbit of the CMP polishing platen. During an orbital polishing operation, the point 30 (and every other point) on the polishing pad surface 18 moves in a circular motion, as indicated by the arrow 31. The diameter of this circular motion is equal to the orbit diameter. In another embodiment of the invention shown in FIG. 3, the platen moves in a rotational path. The arrow 33 in FIG. 3 represents the motion of point 30 on the polishing pad surface 18 during a single rotation of the CMP polishing platen. During a rotational polishing operation, the point 30 (and every other point) on the polishing pad surface 18 moves in a circular motion around the platen axis 28 with a diameter of motion equal to twice the distance of the point from the platen axis 28. Thus, during either the orbital or rotational polishing operation, slurry on the surface of the polishing pad 25 is urged to move in a circular path.

Figure 4:
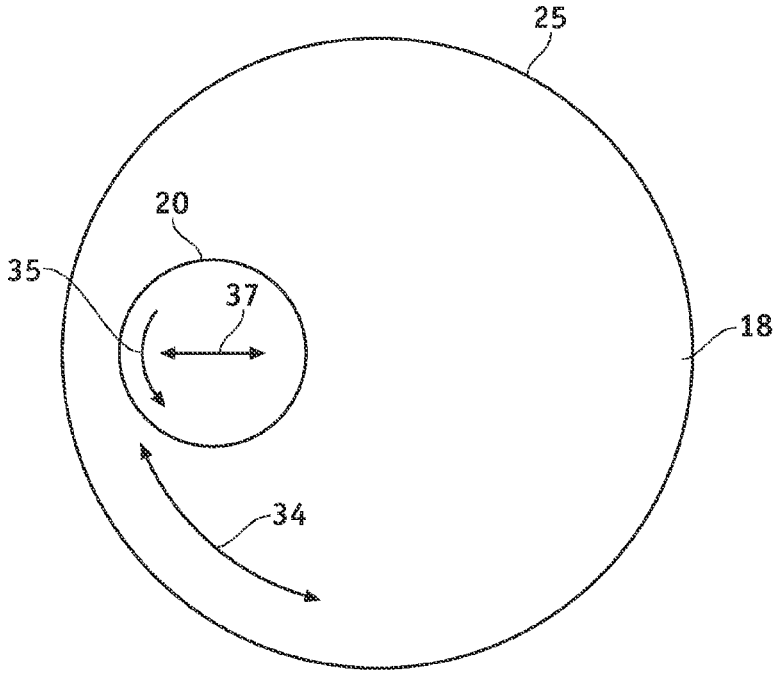
FIG. 4 PRIOR ART
FIG. 4 is a top view of a CMP apparatus polishing pad that is performing a reciprocal rotational polishing technique and a work piece carrier head that is performing rotational motion and dithering.

In a preferred embodiment of an orbital CMP system, an additional component of motion may be utilized by the platen. Referring to FIG. 4, the platen motion may further comprise a reciprocating rotational motion, indicated by double-headed arrow 34, in addition to the orbital motion. Reciprocating rotational motion is a rotational motion about the center of the platen and is utilized in the form of a reciprocating (back and forth) motion approximating 180 degrees in each direction to provide the equivalent of a 360 degree rotation in addition to the orbital motion of the platen. This reciprocating motion in addition to the orbital motion of the platen combines to modify the trajectory of a point on the wafer relative to the pad such that it may no longer be a circular trajectory, as would occur from orbital motion alone. The reciprocating motion serves to further average out effects related to the kinematics of the grooves and other pad features and also the pad condition. The resultant trajectory of a point on the wafer relative to the pad closer approximates a spiral than a circle when the advanced pad motion is utilized. Additionally, the rotation of the carrier head 20, indicated by arrow 35, and thus the wafer, adds yet another relative motion that similarly alters the trajectory and provides averaging. Averaging also may be accomplished by dithering, indicated by double-headed arrow 37, which is an additional form of relative motion that dynamically changes the kinematical relationship between the wafer and the pad by displacing one from the other at some interval. Dithering typically is achieved by enabling the wafer to move back and forth across the face of the polishing pad in a reciprocating side to side motion.

Figure 5:
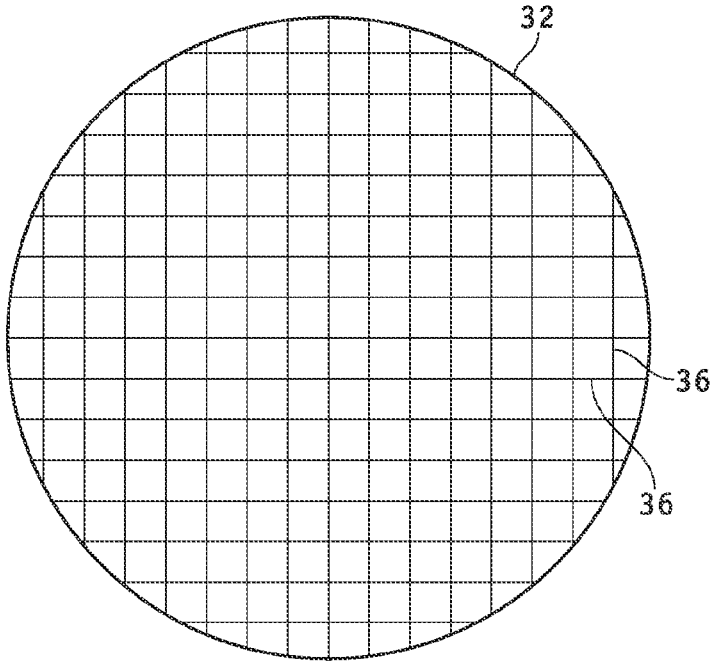
FIG. 5 PRIOR ART
FIGS. 5 and 6 are each top views of polishing pads for a CMP apparatus, the pads having polishing surfaces with a groove patterns formed therein.
Figure 6:
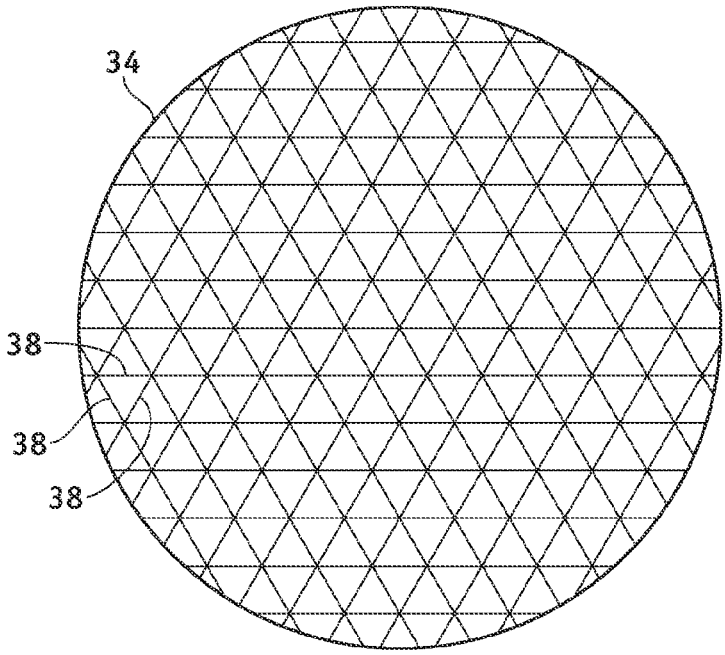
FIG. 6 PRIOR ART

Many polishing pads also include a groove pattern on their polishing surfaces. FIGS. 5 and 6 are top views of polishing pads 32 and 34, respectively, having some exemplary groove patterns on their polishing surfaces. Grooves 36 and 38 facilitate slurry distribution about the polishing pads 32 and 34, but also constrain most of the slurry to within the grooves. Consequently, most of the slurry exposure to the wafer surface tends to approximate the path designated by the arrows 31 and 33 in FIGS. 2 and 3 respectively, although predictable and repeated deviations from that path occur with each rotation as dictated by the paths created by the groove patterns.

A non-uniform material removal rate during wafer polishing is sometimes a result of particular grooves or other topographical features or patterns on the polishing pad repeatedly traversing particular wafer surface regions during polishing. The previously-discussed orbital and rotational CMP systems tend to produce repetitious groove movement along a wafer surface over numerous repeated rotations. Even though the wafer is rotating about the carrier head axis independent of the polishing pad, after numerous rotations by both components the repeating groove movement patterns traced on the wafer surface can produce non-uniform material removal rates across the wafer surface. Although the relative motion of both the orbiting or rotating polishing pad and the spinning wafer enables substantial averaging of pad-to-wafer kinematics, there remains a significant kinematics-related signature resulting from the coincidence of various pad features as they trace predictable paths on the wafer surface. For example, a wafer region in contact with a polishing pad groove experiences very little pressure or friction and consequently undergoes little or no material removal relative to wafer regions in contact with the polishing pad material. Additionally, not all polishing pad regions enable the same wafer removal rates due to variances in pad support, pad wear, slurry distribution, and other reasons. As the various polishing pad regions move relative to the wafer, while being governed by the kinematics of the system motions, they remove material non-uniformly and create kinematics-related removal signatures on the wafer surface. These signatures are typically observed as non-uniformity in removal rate on the wafer surface, and can be measured as a deviation in remaining material thickness that is usually periodic in nature, the periodicity and the magnitude of the deviation being dependant on the system kinematics. This phenomenon is a problem that affects orbital, rotational, linear and other CMP systems. Most CMP systems execute repeating polishing pad and/or wafer movements that produce kinematics-related material removal signatures observed as non-uniformity in removal rate and remaining material thickness on a wafer surface in a similar manner.

According to one embodiment of the invention, uniformity in material removal rate is improved by employing a CMP system that includes a polishing pad having a primarily symmetrical groove pattern with at least one irregularity in the pattern symmetry. As one example, the primarily symmetrical groove pattern includes an asymmetrical feature or attribute. During a polishing operation, the orbital and rotational motion of the polishing pad facilitate a radial displacement of the asymmetrical feature or attribute relative to a radial location on the wafer surface. For an orbital system, the advanced pad motion and the carrier rotation are the primary facilitators of the radial displacement, as they effectively translate the pattern of grooves uniformly over the wafer surface. The rotational motion on a rotational system is sufficient to facilitate this effect. As another example, the polishing pad has a symmetrical groove pattern, but the pattern's center of symmetry is offset with respect to the polishing pad center point, which is also the polishing pad, and platen, axis of motion.

Figure 7:
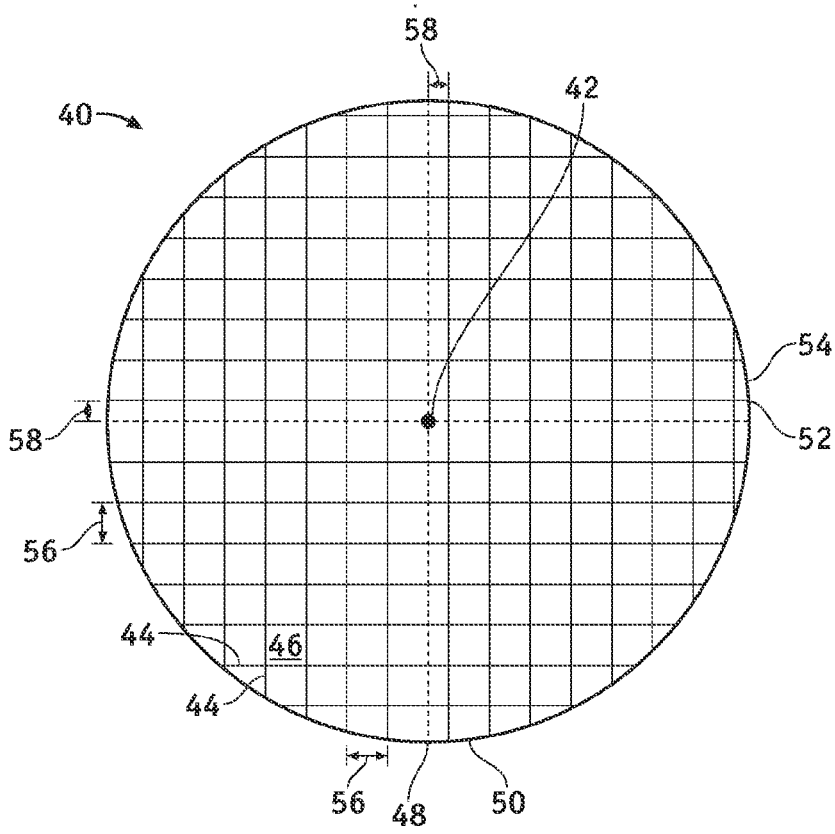
FIG. 7 is a top view of a polishing pad for a CMP apparatus according to an embodiment of the present invention.

FIG. 7 is a top view of one exemplary polishing pad 40. The pad 40 has a groove pattern entrenched in a top surface thereof. The groove pattern includes perpendicular grooves 44 intersecting to form an X-Y grid. The intersecting grooves 44 define "lands" 46 that are surrounded by the grooves 44 or the wafer edge. Although not depicted in FIG. 7, within the lands 46 there may be minor grooves entrenched in the pad surface and forming another pattern. The minor grooves are smaller in depth and/or width than the grooves 44, and function to further distribute slurry within the lands 46 during a polishing process. The irregularity in this pattern symmetry is because of the presence of at least one asymmetrical feature in the groove pattern, which affects the groove pattern's overall symmetry. For example, beginning from the bottom of the polishing pad 40, the grooves 44 that are arranged horizontally are evenly spaced apart by a specific period 56. Likewise, beginning from the left side of the polishing pad, the grooves 44 that are arranged vertically are evenly spaced apart by a specific period 56. However, upon reaching the polishing pad center 42, the horizontal and vertical grooves are spaced apart by a distance that is greater than the specific period 56. Stated another way, the horizontal and vertical grooves are spaced apart from each other by the same distance but are shifted in one direction so that the pattern on half of the pad is at a different distance from the center of the pad than the other half of the pad. The discontinuous vertical line 48 and discontinuous horizontal line 52 represent the next sequential groove moving from left to right, and bottom to top, respectively, on the polishing pad if the groove pattern continued with specific period 56. Instead, the next horizontal and vertical grooves are spaced apart from the preceding groove by an extended distance 58, in addition to the specific period 56. According to one exemplary embodiment, the extended distance 58 is less than or equal to about half the period (P), or $\leqq \frac{1}{2} \cdot P$. As a result, the polishing pad center 42 is not at or substantially close to an axis of symmetry of the land 46 in which it is disposed. Furthermore, the polishing pad center 42 is not a symmetrical center of any shape formed by the grooves 44. Instead, the axis of symmetry of a shape formed by the grooves 44 is substantially offset from the polishing pad center 42 and its axis of motion.

Offsetting the axis of symmetry of a land or a shape formed by the grooves 44 with respect to the polishing pad center 42 substantially diminishes the formation of kinematics-related material removal signatures that would otherwise be observed as a product of non-uniformity in removal rate on a wafer surface. More particularly, the material removal rates that are directly related to the groove kinematics are better averaged about the entire wafer when the axis of symmetry of a land 46 or other groove-defined shape is substantially offset than when it is substantially aligned with the polishing pad center 42.

Figure 8:
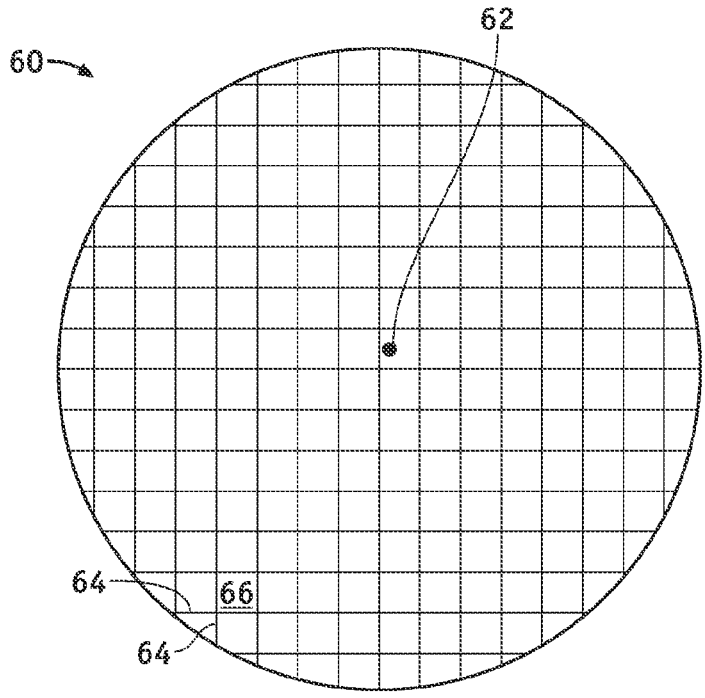
FIG. 8 is a top view of a polishing pad for a CMP apparatus according to another embodiment of the present invention.

As previously discussed, uniformity in material removal rate is also improved by employing a CMP system that includes a polishing pad having a groove pattern that is continuous and uninterrupted, but is shifted in its entirety to thereby cause the symmetrical centers of any shapes formed by the grooves to be offset with respect to the polishing pad's axis of rotation. FIG. 8 is a top view of an exemplary polishing pad 60. The pad 60 has a groove pattern entrenched in a top surface thereof. The groove pattern includes perpendicular grooves 64 intersecting to form an X-Y grid. The intersecting grooves 64 define lands 66 that are surrounded by the grooves 64 or the wafer edge. Although not depicted in FIG. 8, within the lands 66 there may be minor grooves entrenched in the pad surface and forming another pattern. Unlike the embodiment depicted in FIG. 7, the groove pattern is continuous and uninterrupted. All of the grooves 64 are evenly spaced apart by a specific period. However, the entire groove pattern is shifted with respect to the polishing pad center 62. Consequently, the polishing pad center 62 is not at or substantially close to an axis of symmetry of the land 66 in which it is disposed. Furthermore, the polishing pad center 62 is not a symmetrical center of any shape formed by the grooves 64. Instead, the axis of symmetry of a shape formed by the grooves 64 is substantially offset from the polishing pad center 62 and its axis of motion.

Figure 9:
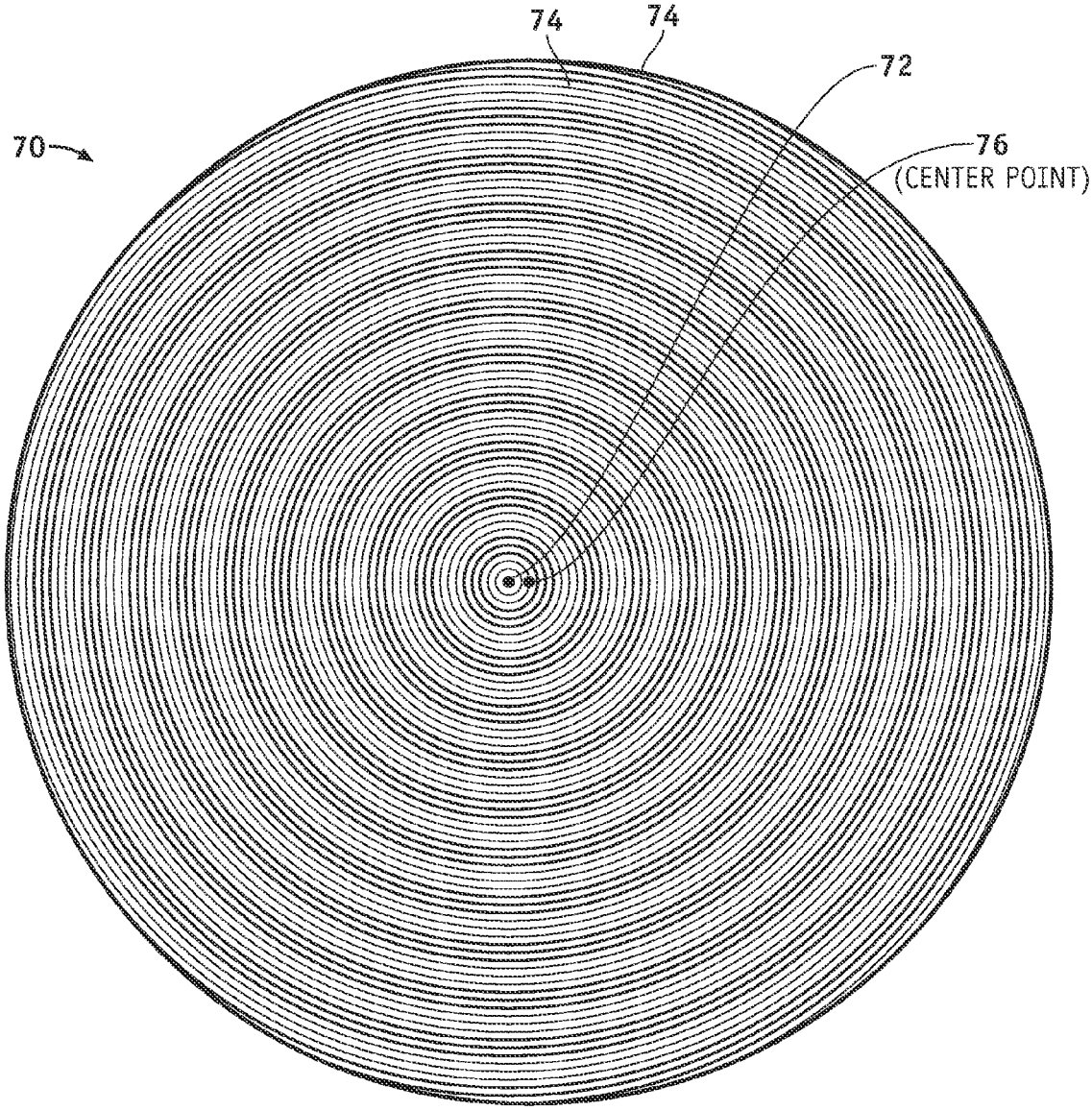
FIG. 9 is a top view of a polishing pad for a CMP apparatus according to another embodiment of the present invention.

FIG. 9 is a top view of another exemplary polishing pad 70. The pad 70 has a groove pattern entrenched in a top surface thereof. The groove pattern consists of a plurality of grooves 74, most of which are formed as a circle. Each circular groove 74 has a different diameter, and the grooves are arranged in a pattern of concentric circles having increasing diameters when traversing the pattern from the innermost circle to the outer most circle. Each circular groove 74 is evenly spaced apart by a specific period. An axis 76 or center point of the innermost circle in the groove pattern is also the axis or center point of all the other circles in the groove pattern. However, the axis of the concentric circles in the groove pattern 74 is substantially offset from the polishing pad center 72, which is the polishing pad axis of motion. As illustrated, the polishing pad center 72 is outside of the innermost circle, and is further outside of at least one circle surrounding the innermost circle. Because of this offset alignment, a few of the outer grooves may not form a complete circle as depicted in FIG. 9.

Figure 10:
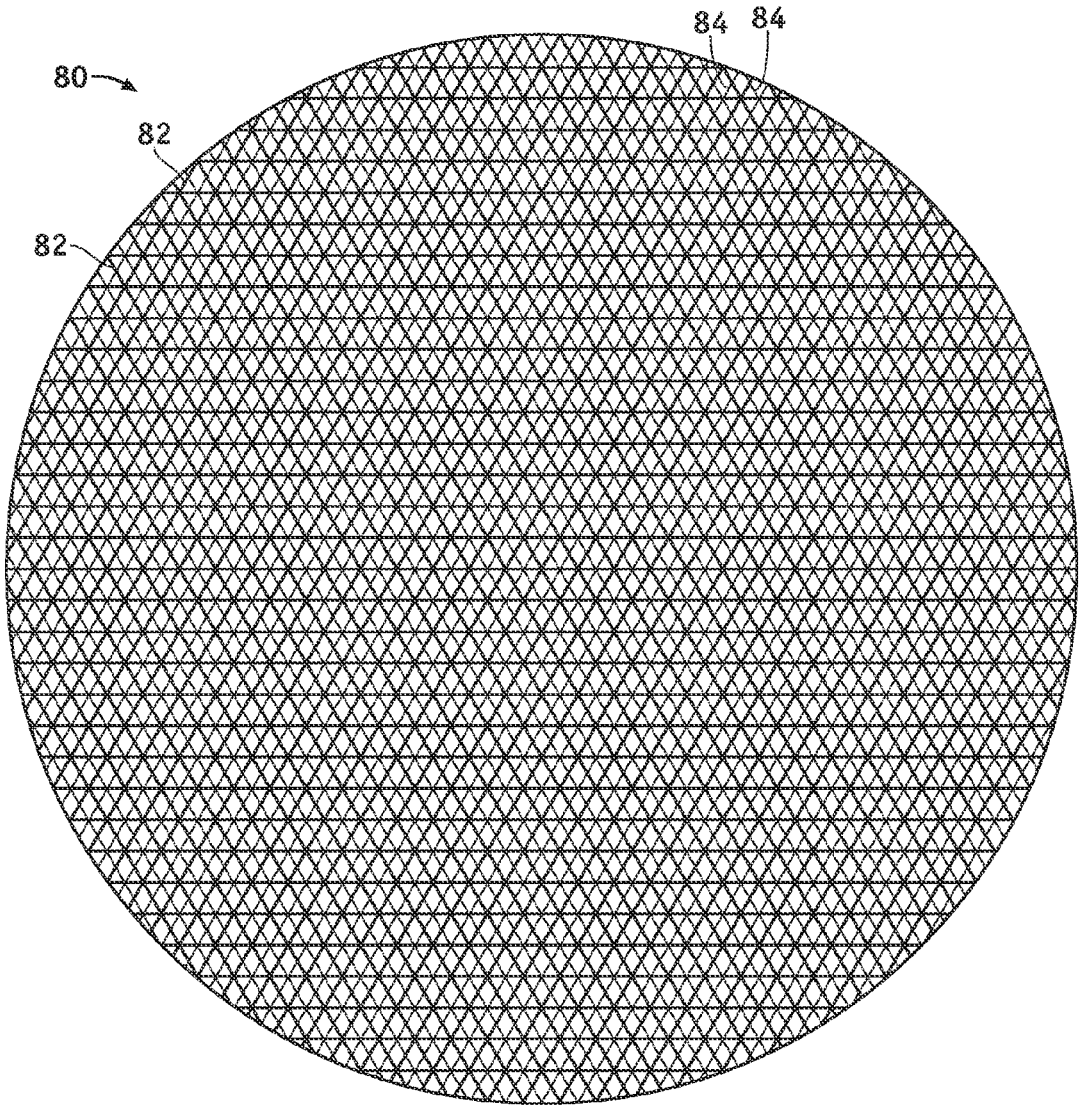
FIG. 10 is a top view of a polishing pad for a CMP apparatus according to another embodiment of the present invention.
Figure 11:
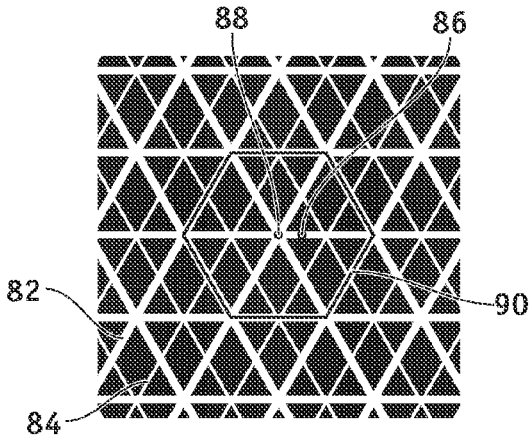
FIG. 11 is an enlarged top partial view of the triangular groove pattern entrenched in the polishing pad depicted in FIG. 10.

FIG. 10 is a top view of yet another exemplary polishing pad 80. The illustrated pad 80 has a triangular groove pattern entrenched in a top surface thereof. FIG. 11 is an enlarged partial view of the triangular groove pattern entrenched in the pad surface to show the pattern symmetry with respect to the polishing pad center 86. The groove pattern consists of a plurality of major grooves 82 and minor grooves 84. The major grooves 82 have a larger cross-sectional area than the minor grooves 84. According to the depicted embodiment, the major grooves 82 have at least a greater width than the minor grooves 84, although the major grooves 82 may also or alternatively have a greater depth than the minor grooves 84 to further impart a larger cross-sectional area to the major grooves 82, measured perpendicular to the pad surface. The triangular groove pattern includes overlapping triangular patterns that further form other symmetrical patterns of polygons including diamonds and hexagons. As illustrated in FIG. 10, the groove pattern is arranged in a manner whereby the polishing pad center 86, which is the polishing pad axis of motion, is offset from a symmetrical center point of any triangle within the groove pattern, and is also offset from any of the other symmetrical patterns or shapes formed by the groove pattern. As just one example, a hexagon 90 defined by six triangles within the groove pattern having a corner-to-corner width of one inch has a center point 88. The polishing pad center 86 is laterally offset from the hexagon center point 88 by a distance of 0.2 inch. Furthermore, the polishing pad center 86 is offset from a symmetrical center of the triangle in which it is disposed, and from any other symmetrical pattern or shape formed by the groove pattern.

As previously discussed, for each of the disclosed embodiments and others in which the axis of symmetry of a land or a shape formed by the grooves is offset with respect to the polishing pad center, the formation of kinematics-related material removal signatures that would otherwise be observed as a product of non-uniformity in removal rate on a wafer surface is remarkably diminished. Material removal rates that are related to the groove kinematics are better averaged about the entire wafer when the axis of symmetry of a groove-defined shape is substantially offset than when it is substantially aligned with the polishing pad center. The polishing pads of the present invention are easily manufactured without requiring new or additional hardware with respect to conventional polishing pads.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A chemical-mechanical polishing apparatus having a polishing pad, the polishing pad comprising:

a polishing pad surface having a center point that lies within an axis of motion for the polishing pad; and a plurality of grooves entrenched in the polishing pad surface and defining a pattern of shapes, wherein the pattern is a primarily symmetrical pattern that has an axis of symmetry that is offset from the polishing pad surface center point, comprises a plurality of perpendicularly intersecting horizontal and vertical grooves that are spaced apart from parallel grooves by a repeating period to define an X-Y grid, and has an asymmetrical element comprising at least two of the intersecting grooves each spaced apart from a parallel groove by a distance that is not the same as that of the repeating period.

2. A chemical-mechanical polishing assembly, comprising:

a platen; and a polishing pad disposed over the platen and having a top surface, the top surface having a center point that lies within an axis of motion for the polishing pad, wherein a plurality of grooves is entrenched in the top surface and defines a pattern of shapes, each shape having an axis of symmetry that is offset from the top surface center point, wherein the pattern of shapes defined by the plurality of grooves is a primarily symmetrical pattern and-comprises a plurality of perpendicularly intersecting horizontal and vertical grooves that are spaced apart by a repeating period to define an X-Y grid, and wherein the pattern of shapes includes an asymmetrical element comprising at least two of the intersecting grooves each spaced apart from a parallel groove by a distance that is not the same as that of the repeating period.

3. A chemical-mechanical polishing assembly comprising:

a platen; and a polishing pad disposed over the platen and having a top surface and a circumference, the top surface having a center point that lies within an axis of motion for the polishing pad, wherein a plurality of grooves is entrenched in the top surface and defines a pattern of shapes, each shape having an axis of symmetry that is offset from the top surface center point, wherein the pattern of shapes defined by the plurality of grooves is a symmetrical pattern having a symmetrical center point that is offset from the top surface center point, wherein the pattern of shapes defined by the plurality of grooves comprises a plurality of perpendicularly intersecting horizontal and vertical grooves that are spaced apart by a repeating period to define an X-Y grid and wherein each of the horizontal and vertical grooves extends from one position on the circumference of the polishing pad to another position on the circumference.

* * * * *